US006356729B1

(12) United States Patent
Sasaki et al.

(10) Patent No.: US 6,356,729 B1
(45) Date of Patent: Mar. 12, 2002

(54) ELECTROPHOTOGRAPHIC TONER, TONER CONTAINER CONTAINING THE TONER, IMAGE FORMING APPARATUS USING THE TONER CONTAINER AND METHOD FOR SUPPLYING THE TONER FROM THE TONER CONTAINER

(75) Inventors: Tamoe Sasaki, Fuji; Satoshi Mochizuki, Numazu, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/541,630

(22) Filed: Apr. 3, 2000

(30) Foreign Application Priority Data

Apr. 7, 1999 (JP) ..... 11-100084
Apr. 7, 1999 (JP) ..... 11-100105

(51) Int. Cl.[7] ..... G03G 15/08; G03G 9/00
(52) U.S. Cl. ..... 399/258; 399/262; 430/110.4
(58) Field of Search ..... 399/252, 258, 399/262; 430/109, 110, 111, 126, 110.4, 111.4

(56) References Cited

U.S. PATENT DOCUMENTS 5,534,981 A * 7/1996 Ohno et al. ..... 399/252
5,731,122 A * 3/1998 Yoshida et al. ..... 430/126
5,750,302 A * 5/1998 Ogawa et al. ..... 430/111 X
5,832,347 A * 11/1998 Kawai et al. ..... 399/252
5,958,640 A * 9/1999 Hasegawa et al. ..... 430/109
5,966,571 A * 10/1999 Tavernier ..... 399/139

FOREIGN PATENT DOCUMENTS

JP 7020705 1/1995

* cited by examiner

*Primary Examiner*—Fred L. Braun
(74) *Attorney, Agent, or Firm*—Cooper & Dunham, LLP

(57) ABSTRACT

A toner with a volume average particle diameter not less than 6.0 μm and a particle distribution such that toner particles having a particle diameter not greater than one half of the number average particle diameter of the toner are present in an amount not greater than 10% by number, and toner particles having a particle diameter not less than 1.5 times the volume average particle diameter of the toner are present in an amount not greater than 15% by volume. The toner is preferably contained in a cylindrical toner container having at least an opening, and a spiral groove formed on the internal surface thereof. The toner container is horizontally set in an image forming apparatus for rotation around the center axis thereof to discharge the toner to a developing device of the image forming apparatus through the opening. A toner supplying method includes providing the toner in the cylindrical container and rotating the container, while horizontally set, around its center axis to discharge the toner from the opening.

14 Claims, 2 Drawing Sheets

1
2
A1
A2
A3
A4
A5
t

ELECTROPHOTOGRAPHIC TONER, TONER CONTAINER CONTAINING THE TONER, IMAGE FORMING APPARATUS USING THE TONER CONTAINER AND METHOD FOR SUPPLYING THE TONER FROM THE TONER CONTAINER

BACKGROUND OF THE INVENTION

1. Field of the Invention

The present invention relates to an electrophotographic toner useful for developing an electrostatic latent image, a toner container containing the toner, an image forming apparatus using the toner container and a method for supplying the toner from the toner container.

2. Discussion of the Related Art

Now is the age of information, and therefore a huge amount of copies are reproduced using electrophotographic copiers. At the present day, various electrophotographic image forming apparatus are known. The image forming apparatus typically include an image bearing member, a charging device, a light irradiating device, a developing device, an image transfer device, a fixing device, a cleaning device, etc. Images are typically formed by the following method:

(1) the charging device charges the entire surface of the image bearing member (i.e., a photoreceptor);

(2) the light irradiating device irradiates the image bearing member with imagewise light to form an electrostatic latent image on the image bearing member;

(3) the developing device develops the latent image with an electrophotographic toner to form a toner image on the image bearing member;

(4) the image transfer device transfers the toner image from the image bearing member to a receiving material;

(5) the fixing device fixes the toner image upon application of heat or pressure, or combination thereof, to produce a document having a fixed image thereon; and (6) the cleaning device removes the toner remaining on the image bearing member even after the toner image is transferred on the receiving material, to prepare for the next image forming operation.

The toner is included in a toner container, and is supplied to the developing area in the developing device. There are two types of toner containers, one of which is a vertical type container and another of which is a horizontal type container. The vertical type container is suitable for supplying a toner to the developing area at a time by reversing the toner container.

The horizontal type container is suitable for gradually supplying a toner to the developing area. Several types of horizontal type containers are known. Japanese Laid-Open Patent Publication No. 7-20705 discloses a horizontal type cylindrical toner container which has spiral guide grooves on the internal surface thereof. This toner container is gradually rotated to supply the toner therein to the developing area.

Recently, the horizontal type toner containers are frequently used for image forming apparatus such as copiers, printers and facsimile machines. However, the horizontal type toner containers have a relatively poor toner discharging ability compared to the vertical type toner containers.

In addition, recently a need for clear images increases more and more. Therefore toners having a high level of function, such as the following toners, are developed and practically used.

(1) toners having a relatively small particle diameter;

(2) toners which do not include an oil;

(3) toners having a spherical shape; and (4) polymerized toners which are prepared by a polymerization method.

These high functional toners generally have a poor fluidity (i.e., a poor discharging ability) although the reason is not known yet. Therefore, these toners tend to remain in the toner containers without being supplied after image forming operations are repeated for a long time.

In addition, these high function toners tend to form the aggregate in which toner particles adhere to each other. When aggregates are formed in a toner, the discharging ability of the toner deteriorates.

These drawbacks of the horizontal toner containers have not been recognized to be solved. Therefore, the solution has not been proposed yet.

SUMMARY OF THE INVENTION

Accordingly, an object of the present invention is to provide a toner having a good discharging ability, i.e., to provide a toner which can be supplied to a developing area in a proper amount (not too little and not too much).

Another object of the present invention is to provide a toner container having a good toner discharging ability.

Yet another object of the present invention is to provide an image forming apparatus provided with a toner container having a good toner discharging ability.

Still another object of the present invention is to provide a method for almost completely supplying a toner contained in a toner container.

To achieve such objects, the present invention contemplates the provision of a toner having a volume average particle diameter not less than 6.0 $\mu$m, and a number average particle diameter, and a particle diameter distribution such that toner particles having a particle diameter not greater than one half of the number average particle diameter of the toner are present in the toner in an amount of not greater than 10% by number, and toner particles having a particle diameter not less than 1.5 times the volume average particle diameter of the toner are present in the toner in an amount of not greater than 15% by volume.

The toner preferably has a one-particle adhesion force not greater than 3.0 dyne/contact.

In another aspect of the present invention, a cylindrical toner container is provided which includes at least an opening, and a spiral guide groove formed on the internal surface thereof and which is used for containing the toner mentioned above and for an image forming apparatus having a toner supplying device including a container supporting member and a toner container rotating member which rotates a toner container.

It is preferable for the toner container to be provided in the image forming apparatus so as to be easily put on or taken off the image forming apparatus.

In yet another aspect of the present invention, an image forming apparatus including a developing device, and a toner supplying device including a container supporting member and a toner container rotating member which rotates the toner container containing the toner mentioned above.

In still another aspect of the present invention, a method for supplying a toner to a developing area of the image forming apparatus mentioned above which includes providing the toner container including the toner mentioned above, setting the toner container in the image forming apparatus, supplying the toner to the developing area of an image forming apparatus while rotating the toner container.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

At first, the toner container of the present invention will be explained referring to FIGS. 1A, 1B and 2.

Figures 1A, 1B:
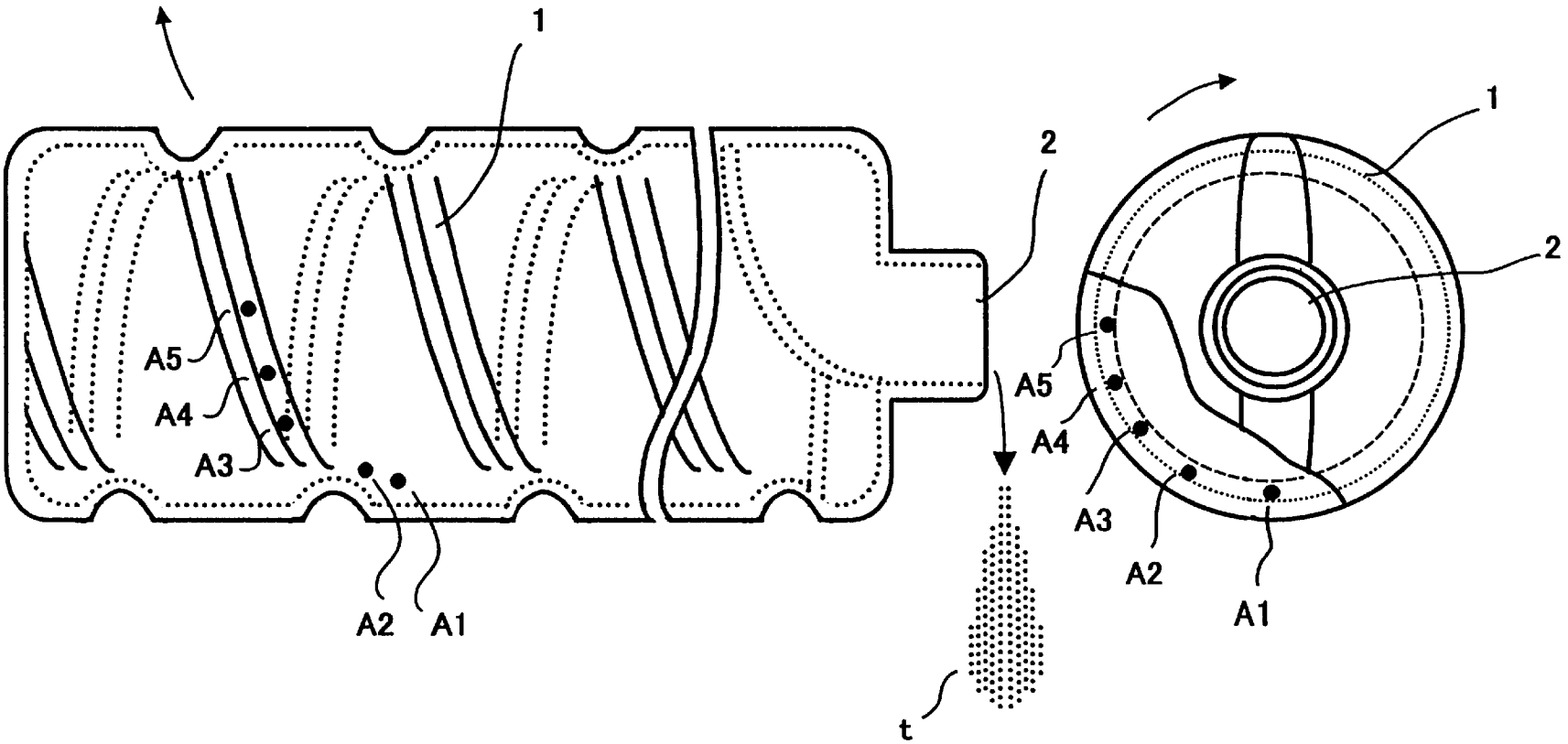
FIG. 1A is a schematic diagram illustrating how the toner of the present invention is discharged from the toner container of the present invention.
FIG. 1B is a schematic diagram illustrating the toner container shown in FIG. 1A from the opening side thereof.

FIG. 1A illustrates an embodiment of the toner container of the present invention, which has a cylindrical shape and an opening 2 and which has at least a spiral guide groove 1 on the internal surface thereof. As shown in FIG. 2, the toner container 1 is horizontally and detachably set in a toner supplying device 10 of an image forming apparatus 100. The toner supplying device 10 includes a toner container supporting member 12 which supports the toner container such that the opening 2 of the toner container leads to a toner supplying portion 16 in a developing device 30 of the image forming apparatus 100. In addition, the toner supplying device 10 includes a toner container rotating member 14 which rotates the toner container such that the container rotates around the center axis thereof.

The toner container of the present invention is not limited to the container 1 as shown in FIG. 1A if the container has a cylindrical shape and an opening, and a spiral guide groove formed on the internal surface of the container.

When the toner container is rotated in a direction indicated by an arrow in FIG. 1A, a point A5 in the internal surface of the container constantly rotates around the center axis of the container and a particle of a toner positioned on the point A5 moves downwardly (i.e., from the point A5 toward a point Al, via points A3 and A2). Thus, the toner particle finally reaches the opening 2 (i.e., a discharging mouth) and is discharged from the opening 2. Character t represents the toner.

Figure 2:
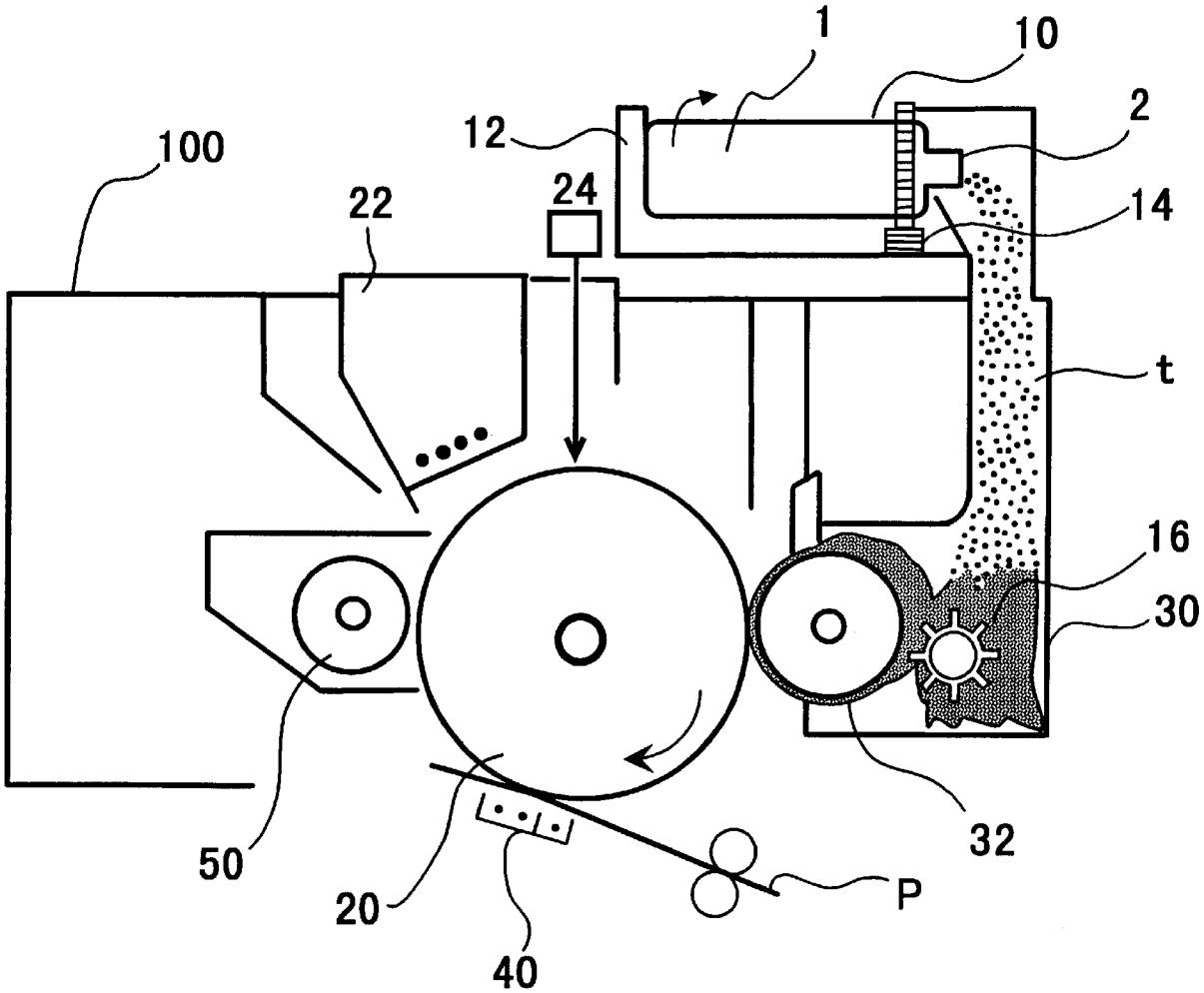
FIG. 2 is a schematic diagram illustrating an embodiment of the image forming apparatus of the invention.

As shown in FIG. 2, the toner layer is formed on a developing roller 32. On the other hand, a photoreceptor 20 is charged with a charger 22. Then an imagewise light irradiating device 24 irradiates the charged photoreceptor with light to form an electrostatic latent image on the photoreceptor 20. The latent image is developed with the toner layer to form a toner image on the photoreceptor 20. The toner image is transferred to a receiving paper P using a transfer device 40. Then the photoreceptor 20 is cleaned with a cleaner 50. The toner image on the receiving paper P is fixed to form a fixed toner image. Thus a document is produced.

Although the toner container has a spiral guide groove in the internal surface thereof, the toner tends to remain in the container while adhering to the internal surface of the container. Recent toners generally have a relatively small diameter and a spherical shape, and include a wax. Therefore, the adhesion force among the particles of the toners is relatively large. When a toner particle adheres on the internal surface of the container, other particles tend to adhere to the toner particle, and thereby the amount of toner particles adhered on the internal surface increases more and more as the container rotates. If the toner particles adhere on the groove 1, the ability of the groove to feed the toner particles to the opening 2 deteriorates, and finally the container cannot supply the toner to the developing device.

The present inventors attempt to solve this problem by improving the fluidity of the toner. As a result, the present inventors discover that a toner having a volume average particle diameter not less than 6.0 $\mu$m, and in addition, having a particle diameter distribution such that toner particles having a particle diameter not greater than one half of the number average particle diameter of the toner are present in the toner in an amount of not greater than 10% by number, and toner particles having a particle diameter not less than 1.5 times the volume average particle diameter of the toner are present in an amount of not greater than 15% by volume, has good fluidity.

When the toner of the present invention is used in the toner container mentioned above, the discharging ability of the container can be improved because the toner tends not to adhere to the internal surface of the container. The quantity of the toner of the present invention remaining in the container of the present invention is little.

If the toner loses one of the properties mentioned above, the fluidity of the toner deteriorates. For, example, if the volume average particle diameter of the toner is not greater than 6.0 $\mu$m, the fluidity of the toner deteriorates although the toner has good aggregation degree (i.e., the toner tends not to aggregate).

The physical properties of the present invention mentioned above can be determined by a known method mentioned later.

The present inventors discover that when a particle of the toner of the present invention further has an adhesion force (hereinafter referred to as one-particle adhesion force) not greater than 3.0 dyne/contact, the fluidity of the toner can be further improved, and thereby the discharging ability of the toner can be improved because the quantity of the toner adhered to the internal surface of the container can be reduced.

In the present invention, the one-particle adhesion force of a toner can be determined by the following method:

(1) Measuring instrument: POWDER COHERENCY METER ED-2000CH (manufactured by Shimazu Corp.)

(2) Quantity of a sample to be measured: 10 g (3) Pressure applied: 5 kg and 10 kg Adhesion forces F of the toner are determined using the following equation (1) when the pressure is 5 kg and 10 kg.

$$F=Mg/s \quad (1)$$

wherein F represents adhesion force (unit: dyne/cm$^2$) of the sample per a unit area of the cross section of the column of the instrument used, M represents a force (mass) (unit: g) needed for breaking the sample, g represents the acceleration of gravity, and s represents the area of cross-section of the column.

Then adhesion force of the toner is determined when the pressure is supposed to be 0 kg by extrapolation.

Then the one-particle adhesion force of the toner per one contact is determined by the following equation (2) (Rampf's equation):

$$H=(8/9)\times\{e/(1-e)\}\times Dp^2\times F \quad (2)$$

wherein e represents a porosity of the sample in the column, and Dp represents a volume average particle diameter (cm) of the toner.

Suitable methods for preparing a toner having one-particle adhesion force not greater than 3.0 dyne/contact include the following methods, but are not limited thereto:

(1) a proper amount of a fluidity improving agent is added to the toner; and (2) the toner is subjected to a treatment to round the toner particles to control the adhesion force.

Suitable fluidity improving agents include silica and titania, which are preferably subjected to a hydrophobic treatment, but are not limited thereto. The fluidity improving agents are added to mother toner particles, which typically include a colorant, a binder resin and a charge controlling agent as main components.

The hydrophobized silica and titania, which are subjected to a hydrophobic treatment, can be prepared, for example, by the following known method:

(1) silica (titania) is treated with a silicone oil or a silicone varnish in water; and (2) the treated silica (titania) is then dried and subjected to a particle loosing treatment.

The particle diameter of the hydrophobized silica and titania is from 0.01 to 0.2 $\mu$m, and preferably from 0.02 to 0.15 $\mu$m.

The toner of the present invention may be a magnetic toner in which a magnetic material is included in the toner particles, or a non-magnetic toner which does not include a magnetic material.

In the case of the non-magnetic toner, there occasionally occurs a problem in that the fluidity of the toner is good for about one month after filling the toner in a container, however the fluidity then deteriorates and thereby the discharging ability of the toner deteriorates. This is because the particles of the toner adhere to each other, resulting in formation of aggregates of the toner.

The present inventors discover that this problem can be solved by using a toner having a ratio, LD/FD, of from 0.5 to 1.0 and an aggregation degree not greater than 25%. By using such a toner, the quantity of the toner remaining in the toner container can be decreased. At this point, LD represents a loose apparent density (i.e., small-estimated apparent density) of a toner when the density is measured without applying pressure, and FD represents a firm apparent density (i.e., large-estimated apparent density) of the toner when the density is measured after tapping the vessel including the toner sample to be measured 50 times. The measuring method of the loose apparent density, firm apparent density and aggregation degree will be explained later in detail.

In addition, when the toner has a loose apparent density not less than 0.30 g/cm$^3$, and an angle of repose not greater than 35°, the toner has better discharging ability. Therefore, the quantity of the toner remaining in the toner container can be further decreased.

By using a toner having a ratio, LD/FD, is not less than 0.5 and an aggregation degree not greater than 25%, the poor discharging problem can be improved. However, when imparting good fluidity to the toner of the present invention, the ratio LD/FD of the toner tend to decrease. Therefore, the toner of the present invention having good discharging ability can be prepared by properly controlling the ratio and the aggregation degree.

The loose apparent density is preferably not less than 0.30 g/cm$^3$, and more preferably from 0.30 to 0.50 g/cm$^3$. The firm apparent density is preferably from 0.40 to 0.60 g/cm$^3$.

When a toner container including a non-magnetic toner is horizontally set in an image forming apparatus, the discharging property of the toner depends on the loose apparent density and angle of repose of the toner. When the toner of the present invention has angle of repose not greater than 35°, and preferably not greater than 23°, the discharging property of the toner can be enhanced. In addition, the toner further has a small-estimated apparent density not less than 0.30, the discharging property of the toner can be further enhanced.

The method for supplying the toner in the present invention is as follows:

(1) providing a cylindrical toner container having at least an opening, which is sealed with a cap, and a spiral guide groove formed on the internal surface thereof; and an image forming apparatus including a developing device, and a developer supplying device having a container supporting member, and optionally a cap opener;

(2) setting the toner container in the toner containing supporting member such that the toner container is set horizontally;

(3) opening the cap with the cap opener or by hand;

(4) rotating the toner container such that the container rotates its center axis to discharge the toner in the container from the opening and feed the toner to the developing device.

Next the method for manufacturing the toner of the present invention will be explained.

The toner of the present invention includes mother toner particles including as main components a colorant, a binder resin and additives such as a charge controlling agent and the like.

The mother toner particles can be prepared, for example, by the following method:

(1) the materials mentioned above are blended under dry conditions;

(2) the blended materials are melted and kneaded;

(3) the kneaded mixture is cooled and then crushed;

(4) the powder is pulverized with a pulverizer using jet air; and (5) the powder is classified with an air classifier to prepare mother toner particles having a desired particle diameter.

In addition, additives such as a fluidity improving agent and the like can be optionally added to the mother toner particles.

In order to prepare the toner of the present invention having physical properties mentioned above, it is important to control the particle diameter distribution of the toner. In addition, it is important to select a proper binder resin and to control the addition quantity of the additives.

Specific examples of the binder resins for use in the present invention include polymers of styrene and its derivatives, such as polystyrene, and poly-p-chlorostyrene, polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolimers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic acid resins, rosin, modified rosin, terpene resins, aliphatic or alicyclic hydrocarbon resins, aromatic hydrocarbon resins, chlorinated paraffins, paraffin waxes. These materials can be used alone or in combination.

Suitable colorants include known dyes and pigments. Specific examples of the colorants include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthracene Yellow BGL, isoindolinone yellow, red iron oxide, red lead, orange lead, cadmium red, cadmium mercury red, antimony orange, Permanent Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titaniumoxide, zinc oxide, lithopone, and the like. These dyes and pigments are employed alone or in combination. The content of a coloring agent in the toner of the present invention is preferably from about 0.1 to about 50 parts by weight per 100 parts by weight of the binder resin.

In addition, a charge controlling agent can be added in the toner if desired, to improve the charge property of the toner. By adding a charge controlling agent to a toner, the charge quantity of the toner can be increased, the charge increase time can be shortened, and the dependency of the charge property on environmental changes can be decreased. Suitable charge controlling agents for use in the present invention include known charge controlling agents. When color toners are prepared, the following compounds can be employed.

Specific examples of the charge controlling agents for use in the toner of the present invention include Nigrosine dyes, triphenyl methane dyes, metal-containing complex dyes including chromium, chelate dyes of molybdic acid, Rhodamine dyes, alkoxy type amines, quarternary ammonium salts (including fluorine-modified quarternary ammonium salts), alkylamides, phosphor and its compounds, tungsten and its compounds, fluorine-containing active agents, salicylic acid metal salts, metal salts of salicylic acid derivatives, and the like. Specifically, such as Bontron 03 (Nigrosine dye), Bontron P-51 (quarternary ammonium salt), Bontron S-34 (metal-containing azo dye), E-82 (oxynaphthoic acid type metal complex), E-84 (salicylic acid type metal complex), and E-89 (phenol type condensation products), which are manufactured by Orient Chemical Industries Co., Ltd.; TP-302 and TP-415 (quaternary ammonium salts molybdenum complex) which are manufactured by Hodogaya Chemical Co., Ltd.; Copy Charge PSY VP2038 (quarternary ammonium salt), Copy Blue PR (triphenylmethane derivative), Copy Charge NEG VP2036 (quarternary ammonium salts), and Copy Charge NX VP434 (quarternary ammonium salt), which are manufactured by Hoechst AG; LRA-901, and LR-147 (boron complex), which are manufactured by Japan Carlit Co.; copper Phthalocyanine; perylene; quinacridone; azo type pigments; and polymer compounds having a functional group such as a sulfo group, a carboxyl group, and a quarternary ammonium salt group.

In order to impart a releasing ability to the toner, a wax can be added in the toner. Waxes having a melting point of from 40 to 120° C., and preferably from 50 to 110° C., are preferably used. When the melting point of the wax used is too high, the fixing property of the resultant toner images tend to deteriorate particularly when the toner images are fixed at relatively low temperature. On the contrary, when the melting point is too low, the offset resistance and durability of the resultant toner tend to deteriorate. The melting point can be determined by a method using a differential scanning calorimeter (DSC). Namely, the melting point is defined as the temperature at which a peak caused by melting can be observed when several milligrams of a sample is heated at a temperature increasing speed (for example, 10° C./min).

Suitable waxes for use in the toner of the present invention include solid paraffin waxes, microcrystalline waxes, rice waxes, fatty acid amide type waxes, fatty acid type waxes, aliphatic monoketones, fatty acid metal salt waxes, fatty acid ester waxes, partially-saponified fatty acid ester waxes, silicone varnishes, higher alcohols, carnauba wax, and the like. In addition, low-molecular-weight polyolefins such as polyethylene and polypropylene can also be used. In particular, it is preferable to use polyolefins having a softening point of from 70 to 150° C., and preferably from 120 to 150° C.

The toner of the present invention preferably includes an external additive. Suitable external additives include the fluidity improving agents mentioned above. In addition, inorganic fine particles can also be used as the external additive. The primary particle diameter of the inorganic fine particles is preferably from 5 mμto 2 μm, and more preferably from 5 mμto 500 mμ. The specific surface area of the inorganic fine particles is preferably from 20 to 500 $m^2/g$. The content of the inorganic fine particles in the toner is from 0.01 to 5% by weight, and more preferably from 0.01 to 2.0% by weight.

Specific examples of the inorganic fine particles include silica, alumina, titanium oxide, barium titanate, magnesium titanate, calcium titanate, strontium titanate, zincoxide, tin oxide, siliceous sand, clay, mica, wollastonite, diatomaceous earth, chromium oxide, cerium oxide, red iron oxide, antimony trioxide, magnesium oxide, zirconium oxide, barium sulfate, magnesium oxide, barium carbonate, calcium carbonate, silicon carbide, silicon nitride and the like.

Next, the methods for measuring the physical properties will be explained. The loose apparent density, firm apparent density, aggregation degree, and angle of repose are measured using a powder tester type PT-N manufactured by HOSOKAWA MICRON CORPORATION.

(1) Particle Diameter

The number-basis particle diameter distribution and volume-basis particle diameter of particles of a toner are measured using Coulter Counter type TA-II (manufactured by Coulter Electronics, Inc.). A 1% aqueous solution of NaCl prepared using a first class sodium chloride is used as an electrolytic solution. A small amount of a surfactant, which serves as a dispersing agent, is contained in a vessel. A sample to be measured is added in the vessel, and then the electrolytic solution prepared above is added therein. The mixture is dispersed with a supersonic dispersing machine for about 1 to 3 minutes. The particle diameter of the sample in a range of from 2 $\mu$m to 40 $\mu$m is measured on a number basis by Coulter Counter type TA-II having an aperture of 100 $\mu$m.

(2) Loose Apparent Density

A powder tester (PT-N, manufactured by HOSOKAWA MICRON CORPORATION) is used as a measuring instrument. A 246-mesh sieve is set in a vibration plate. A powder sample to be measured is contained in the sieve in an amount of 250 cc and vibrated for 30 seconds so as to fill a vessel set under the sieve with the powder sample. Then the upper portion of the powder sample in the vessel is removed with a blade so that the surface of the powder levels to the top surface of the vessel. The powder sample in the vessel is weighed. This operation is repeated 5 times to obtain an average weight. The powder tester PT-N automatically performs these operations.

Loose apparent density=W(g)/V(cc)

wherein W represents the average weight of the powder, and V represents the capacity of the vessel. The capacity of the vessel used for the powder tester PT-N is 100 cc.

(3) Firm Apparent Density

The procedure for measurements of the firm apparent density is repeated except that the vessel is tapped 50 times before the upper portion of the powder is removed.

(4) Aggregation Degree

Three sieves having openings of 44 $\mu$m, 74 $\mu$m and 146 $\mu$m, respectively, are set on a vibration plate of the powder tester PT-N such that a sieve having larger openings is set at an upper position. A toner sample of 2.0 g is contained in the uppermost sieve and vibrated in amplitude of 1 mm for 30 seconds. The aggregation degree is obtained by the following equation:

$$\text{Aggregation degree (\%)}=\{Wt(g)/2.0\}\times 100$$

wherein Wt represents the total weight of the toner remaining on the three sieves.

(5) Angle of Repose

The procedure for measurements of loose apparent density is repeated except that the vessel is replaced with a table exclusively used for measuring angle of repose, and the vibration time is changed to 180 seconds. The angle of repose of the powder sample is measured with an arm exclusively used for measuring angle of repose. This operation is repeated 5 times to obtain an average value.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Non-magnetic Toner

| | |
|---|---|
| Polyester resin (manufactured by Sanyo Chemical Industries Ltd.) | 100 |
| Carbon black (#44, manufactured by Mitsubishi Chemical Corp.) | 10 |
| Charge controlling agent (TRH, manufactured by Hodogaya Chemical Co., Ltd.) | 2 |
| Releasing agent (Biscol 550P, manufactured by Sanyo Chemical Industries Ltd.) | 6 |

The mixture was melted and kneaded using a one-axis kneader. After being cooled, the mixture was pulverized with a jet mill and classified to prepare mother toner particles having a desired particle diameter.

Then a fluidity improving agent (hydrophobized silica or hydrophobized titania, each of which has an average particle diameter of about 0.02 $\mu$m) was added to the mother toner particles to prepare a toner. The concentration of the fluidity improving agent was 0.2, 0.4, 0.6, 0.8, or 1.0 parts by weight per 100 parts by weight of the mother toner particles.

Thus, seventeen toners (Nos. 1 to 17) were prepared. The addition quantity of the fluidity improving agents in each toners are shown in Table 1.

Seven hundred grams of one of the thus prepared toners was contained in a toner container, RICOH Black Toner TYPE 10D, which has the structure as shown in FIGS. 1A and 1B, and set in an electrophotographic copier, IMAGIO DA505 manufactured by RICOH CO. LTD. Copies of an original chart having an image ratio of 6% were continuously formed. The weight of the toner remaining in the toner container was measured when a warning lamp "Toner End" was burned. The other toners were also subjected to this copying test.

The results are shown in Table 2, in which the physical properties of each toner are also shown.

TABLE 1

| Toner | Content of silica in the toner (% by weight) | Content of titania in the toner (% by weight) |
|---|---|---|
| No. 1 | 0 | 0 |
| No. 2 | 0.4 | 0 |
| No. 3 | 0.6 | 0 |
| No. 4 | 1.0 | 1.0 |
| No. 5 | 0.2 | 0 |
| No. 6 | 0.4 | 0 |
| No. 7 | 0.6 | 0 |
| No. 8 | 0.8 | 0 |
| No. 9 | 1.0 | 0 |
| No. 10 | 0.6 | 0 |
| No. 11 | 0.6 | 0 |
| No. 12 | 0.6 | 0 |
| No. 13 | 0.6 | 0 |
| No. 14 | 0.6 | 0 |
| No. 15 | 0.6 | 0 |
| No. 16 | 0.4 | 0 |
| No. 17 | 0.4 | 0 |

TABLE 2

| Toner | Dv (μm) | Dn (μm) | $C_{SP}$ (N %) | $C_{LP}$ (V %) | LD/FD | LD | AD (%) | AR (°) | H (dyne/cont.) | $W_{RT}$ (g) |
|---|---|---|---|---|---|---|---|---|---|---|
| No. 1 | 12.0 | 9.6 | 0.9 | 2.5 | 0.48 | 0.33 | 22.5 | 28 | 4.3 | 37 |
| No. 2 | 12.0 | 9.6 | 0.9 | 2.5 | 0.50 | 0.36 | 17.5 | 26 | 2.9 | 19 |
| No. 3 | 12.0 | 9.6 | 0.9 | 2.5 | 0.51 | 0.38 | 13.8 | 21 | 2.7 | 15 |
| No. 4 | 12.0 | 9.6 | 0.9 | 2.5 | 0.81 | 0.42 | 5.5 | 12 | 1.9 | 1 |
| No. 5 | 9.1 | 7.3 | 5.5 | 10.7 | 0.44 | 0.31 | 27.3 | 37 | 3.3 | 49 |
| No. 6 | 9.1 | 7.3 | 5.5 | 10.7 | 0.55 | 0.33 | 24.8 | 33 | 2.8 | 27 |
| No. 7 | 9.1 | 7.3 | 5.5 | 10.7 | 0.57 | 0.34 | 23.2 | 27 | 2.4 | 15 |
| No. 8 | 9.1 | 7.3 | 5.5 | 10.7 | 0.61 | 0.36 | 22.2 | 23 | 2.2 | 10 |
| No. 9 | 9.1 | 7.3 | 5.5 | 10.7 | 0.62 | 0.36 | 20.3 | 22 | 2.0 | 3 |
| No. 10 | 7.8 | 6.1 | 7.4 | 13.8 | 0.72 | 0.32 | 24.6 | 31 | 2.6 | 28 |
| No. 11 | 7 | 5.8 | 0.5 | 11.5 | 0.75 | 0.31 | 25.2 | 35 | 2.9 | 39 |
| No. 12 | 6.5 | 4.7 | 0.3 | 0.4 | 0.76 | 0.31 | 24.1 | 36 | 2.8 | 33 |
| No. 13 | 5.7 | 4.1 | 9.5 | 14.8 | 0.72 | 0.32 | 27.1 | 40 | 2.7 | 88 |
| No. 14 | 9.8 | 7.5 | 2.5 | 14.7 | 0.65 | 0.37 | 19.8 | 23 | 2.8 | 5 |
| No. 15 | 10.5 | 8.6 | 0.9 | 10.1 | 0.61 | 0.37 | 18.8 | 23 | 2.6 | 5 |
| No. 16 | 9.0 | 7.7 | 12.5 | 14.5 | 0.72 | 0.28 | 26.5 | 35 | 3.0 | 58 |
| No. 17 | 9.5 | 7.8 | 0.5 | 18.6 | 0.74 | 0.33 | 24.2 | 38 | 2.9 | 53 |

Lv: Volume-average particle diameter of the mother toner particles (μm)
Dn: Number-average particle diameter of the mother toner particles (μm)
$C_{SP}$: Content of small mother toner particles having a particle diameter not greater than one half of the number average particle diameter of the mother toner particles in the mother toner particles (% by number)
$C_{LP}$: Content of large mother toner particles having a particle diameter not less than 1.5 times the volume average particle diameter of the mother toner particles in the mother toner particles (% by volume)
LD/FD: Loose apparent density/firm apparent density
LD: Loose apparent density (g/cm$^3$)
AD: Aggregation degree (%)
AR: Angle of repose (°)
H: One-particle adhesion force (dyne/contact)
$W_{RT}$: Weight of toner remaining in the toner container (g)

As can be understood from Table 2, the toner of the present invention (Nos. 1 to 12 and 14 to 15) has good discharging property. Namely, the weight of the toner remaining in the container is less than 50 g. In the toners of No. 13, 16 and 17, which are not the toner of the present invention, a relatively large amount (greater than 50 g) of toner remains in the container.

In particular, when the angle of repose is not greater than about 23, the toner has excellent discharging property.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications No. 11-100084 and 11-100105, both filed on Apr. 7, 1999, the entire contents of which are herein incorporated by reference.

What is claimed is:

1. An electrophotographic toner comprising particles, herein the particles have a volume average particle diameter not less than 6.0 μm, and a number average particle diameter, and a particle diameter distribution such that the particles having a particle diameter not greater than one half of said number average particle diameter of the toner are present in the toner in an amount of not greater than 10% by number, and the particles having a particle diameter not less than 1.5 times said volume average particle diameter of the toner are present in the toner in an amount of not greater than 15% by volume.

2. The electrophotographic toner according to claim 1, wherein the toner has a one-particle adhesion force not greater than 3.0 dyne/contact.

3. The electrophotographic toner according to claim 2, wherein the toner further comprises a fluidity improving agent as an external additive, and wherein the fluidity improving agent comprises at least one of hydrophobized silica and hydrophobized titania.

4. The electrophotographic toner according to claim 3, the fluidity improving agent including hydrophobized silica, wherein the hydrophobized silica is present in the toner in an amount of 0.5% to 2.0% by weight.

5. The electrophotographic toner according to claim 4, the fluidity improving agent including hydrophobized silica, wherein the hydrophobized silica has a particle diameter of from 0.01 μm to 0.2 μm.

6. The electrophotographic toner according to claim 3, the fluidity improving agent including hydrophobized titania, wherein the hydrophobized titania is present in the toner in an amount of 0.5 to 1.5% by weight.

7. The electrophotographic toner according to claim 4, the fluidity improving agent including hydrophobized titania, wherein the hydrophobized titania has a particle diameter of from 0.01 to 0.2 μm.

8. The electrophotographic toner according to claim 2, wherein the toner is a non-magnetic toner, and wherein the toner has an aggregation degree not greater than 25%, and has a loose apparent density LD and a firm apparent density FD such that a ratio LD/FD is from 0.5 to 1.0.

9. The electrophotographic toner according to claim 2, wherein the toner is a non-magnetic toner, and wherein the toner has a loose apparent density of not less than 0.30 g/cm$^3$, and an angle of repose not greater than 35°.

10. The electrophotographic toner according to claim 2, wherein the toner is a non-magnetic toner, and wherein the toner has an angle of repose not greater than about 23°.

11. A cylindrical toner container having at least an opening, and a spiral guide groove formed on an internal surface thereof, wherein the container contains the toner according to claim 1 therein.

12. A toner supplying device useful for electrophotographic image forming apparatus, comprising:

a cylindrical toner container which has at least an opening, and a spiral guide groove formed on an internal surface thereof and which contains a toner;

a container supporting member configured to support the container such that the toner container is horizontally set; and a toner container rotating member configured to rotate the container such that the toner container rotates around a center axis thereof, to discharge the toner from the opening, wherein the toner is the toner according to claim 1.

13. An electrophotographic image forming apparatus comprising:

an image bearing member which bears an electrostatic latent image;

a developing device which develops the latent image with a toner to form a toner image on the image bearing member; and a toner supplying device which comprises:

a cylindrical toner container having at least an opening, and a spiral groove formed on an internal surface thereof, and containing a toner therein;

a container supporting member configured to support the container such that the container is horizontally set; and a toner container rotating member configured to rotate the container such that the toner container rotates around a center axis thereof, to supply the toner from the container to the developing device through the opening, wherein the toner is the toner according to claim 1.

14. A toner supplying method comprising the steps of:

providing a cylindrical toner container having at least an opening, and a spiral guide groove formed on an internal surface thereof, and containing a toner therein; and rotating the toner container around a center axis of the container while the toner container is horizontally set, to discharge the toner from the opening, wherein the toner is the toner according to claim 1.

* * * * *